US011476591B2

(12) United States Patent
Brar et al.

(10) Patent No.: US 11,476,591 B2
(45) Date of Patent: Oct. 18, 2022

(54) MULTI-PORT MULTI-BEAM ANTENNA SYSTEM ON PRINTED CIRCUIT BOARD WITH LOW CORRELATION FOR MIMO APPLICATIONS AND METHOD THEREFOR

(71) Applicant: BENCHMARK ELECTRONICS, INC., Tempe, AZ (US)

(72) Inventors: Rajveer Singh Brar, Tempe, AZ (US); Mark Felipe, Tempe, AZ (US)

(73) Assignee: BENCHMARK ELECTRONICS, INC., Tempe, AZ (US)

( * ) Notice: Subject to any disclaimer, the term of this patent is extended or adjusted under 35 U.S.C. 154(b) by 36 days.

(21) Appl. No.: 17/015,559

(22) Filed: Sep. 9, 2020

(65) Prior Publication Data

US 2021/0028556 A1 Jan. 28, 2021

Related U.S. Application Data

(60) Provisional application No. 62/877,096, filed on Jul. 22, 2019.

(51) Int. Cl.

| | |
|---|---|
| ***H01Q 9/28*** | (2006.01) |
| ***H01Q 21/06*** | (2006.01) |
| ***H01Q 19/30*** | (2006.01) |
| ***H01Q 1/48*** | (2006.01) |
| ***H01Q 9/04*** | (2006.01) |

(52) U.S. Cl.

CPC ..... *H01Q 21/067* (2013.01); *H01Q 1/48* (2013.01); *H01Q 9/045* (2013.01); *H01Q 19/30* (2013.01); *H01Q 21/062* (2013.01)

(58) Field of Classification Search

CPC ..... H01Q 9/28; H01Q 19/30; H01Q 1/38; H01Q 21/06

See application file for complete search history.

(56) References Cited

U.S. PATENT DOCUMENTS

| | | | | |
|---|---|---|---|---|
| 2003/0034917 | A1* | 2/2003 | Nishizawa | H01Q 5/321 343/795 |
| 2007/0152903 | A1* | 7/2007 | Lin | H01Q 3/242 343/795 |
| 2009/0231225 | A1* | 9/2009 | Choudhury | H04B 7/0682 343/893 |
| 2011/0063187 | A1* | 3/2011 | Huang | H01Q 1/38 343/893 |
| 2013/0069837 | A1* | 3/2013 | Cozzolino | H01Q 13/10 343/727 |
| 2013/0300624 | A1* | 11/2013 | Fakharzadeh Jahromi | H01Q 9/065 343/793 |

(Continued)

OTHER PUBLICATIONS

[1 ] N. O. Parchin, M. Shen and G. F. Pedersen, "End-fire phased array 5G antenna design using leaf-shaped bow-tie elements for 28/38 GHz MIMO applications," 2016 IEEE International Conference on Ubiquitous Wireless Broadband (ICUWB), Nanjing, 2016, pp. 1-4.

(Continued)

*Primary Examiner* — Hasan Islam

(74) *Attorney, Agent, or Firm* — Weiss & Moy, P.C.; Jeffrey D. Moy

(57) ABSTRACT

An antenna assembly has a dielectric substrate. A plurality of end fire antennas in a Yagi-Uda configuration is positioned around edges of the dielectric substrate.

11 Claims, 6 Drawing Sheets

(56) References Cited

U.S. PATENT DOCUMENTS

2016/0087348 A1* 3/2016 Ko ..... H01Q 1/243
455/73

OTHER PUBLICATIONS

N. Ojaroudiparchin, M. Shen and G. F. Pedersen, "Design of Vivaldi antenna array with end-fire beam steering function for5G mobile terminals," 2015 23rd Telecommunications Forum Telfor (TELFOR), Belgrade, 2015, pp. 587-590.

Y. Li and K. Luk, "A Multibeam End-Fire Magnetoelectric Dipole Antenna Array for Millimeter-Wave Applications," in IEEE Transactions on Antennas and Propagation, vol. 64, No. 7, pp. 2894-2904, Jul. 2016.

M. Sun, X. Qing and Z. N. Chen, "60-GHz End-Fire Fan-Like Antennas With Wide Beamwidth," in IEEE Transactions an Antennas and Propagation, vol. 61, No. 4, pp. 1616-1622, Apr. 2013.

A. Dadgarpour, B. Zarghooni, B. S. Virdee and T. A. Denidni, "Millimeter-Wave High-Gain SIW End-Fire Bow-tie Antenna," in IEEE Transactions on Antennas and Propagation, vol. 63, No. 5, pp. 2337-2342, May 2015.

[6] H. Huang, J. Lu and P. Hsu, "A Compact Dual-Band Printed Yagi-Uda Antenna for GNSS and CMMB Applications," in IEEE Transactions on Antennas and Propagation, vol. 63, No. 5, pp. 2342-2348, May 2015.

* cited by examiner

MULTI-PORT MULTI-BEAM ANTENNA SYSTEM ON PRINTED CIRCUIT BOARD WITH LOW CORRELATION FOR MIMO APPLICATIONS AND METHOD THEREFOR

RELATED APPLICATIONS

This patent application is related to U.S. Provisional Application No. 62/877,096 filed Jul. 22, 2019, entitled "MULTI-PORT MULTI-BEAM ANTENNA SYSTEM ON PRINTED CIRCUIT BOARD WITH LOW CORRELATION FOR MIMO APPLICATIONS" in the name of the same inventors, and which is incorporated herein by reference in its entirety. The present patent application claims the benefits of the above identified application.

TECHNICAL FIELD

The present application relates generally to an antenna device and method, and more specifically, to a multi-port multi-beam antenna device having a low correlation coefficient between ports for multiple-input multiple-output (MIMO) applications.

BACKGROUND

In wireless communication systems, antenna arrays may be used. The antenna arrays may be used at devices on one or both ends of a communication link. The antenna arrays may be used to suppress multipath fading and interference, and to increase system capacity by supporting multiple users and/or higher data rate transmissions.

Antenna arrays may be defined as a set of multiple connected antennas which may work together as a single antenna to transmit or receive radio waves. In general, the larger the number of individual antennas elements used, the higher the gain and the narrower the beam.

One advantage of devices using antenna arrays is that transmit signals can be beamformed from one device to the other. When beamforming is employed, each of the transmitters in one device transmits the same signal but with different amplitudes and phases through the respective antennas to the other device. Beamformed signals improve the signal-to-noise ratio (SNR) at the receiving device by exploiting the multipath effects of the communication channel between the two devices.

Beamforming can be achieved with either analog or digital topologies. However, both have their drawbacks. Analog beamforming is more conventional than digital and may be implemented with either phase shifters or delay lines. The number required in each component may grow multiplicatively according to the number of antenna elements and the number of radiating beams per element. Digital beamforming is an alternative to analog beamforming, but typically requires a large number of RF chains and the required baseband signal processing can be computationally challenging. In both cases of beam forming, conventional phased array antennas have limited scan range due to a phenomenon called scan blindness.

Therefore, it would be desirable to provide a device and method that overcomes the above. The device and method would provide a technique for omnidirectional signal propagation for MIMO systems, bypassing the need for beamforming.

SUMMARY

In accordance with one embodiment, an antenna assembly is disclosed. The antenna assembly has a dielectric substrate. A plurality of end fire antennas in a Yagi-Uda configuration is positioned around edges of the dielectric substrate.

In accordance with one embodiment, an antenna assembly is disclosed. The antenna assembly has a dielectric substrate, wherein the dielectric substrate is a multi-layer Liquid Crystal Polymer (LCP) circuit board. A plurality of end fire antennas in a Yagi-Uda configuration is positioned around edges of the dielectric substrate. Each of the end fire antennas has an upper dipole pair and a lower dipole pair. The upper dipole pair is formed of a first set of parallel dipoles and the lower dipole pair is formed of a second set of parallel dipoles, the first set of parallel dipoles and the second set of parallel dipoles are each of a different length to support separate $\lambda/2$ resonance modes. A metallic wall is formed around a back and side areas of the upper dipole pair and the lower dipole pair. A ground plane is coupled to the lower dipole pair. A transmission line coupled to the upper dipole pair. A device for dual polarized broadside radiations is formed on a top surface of a center area of the dielectric substrate.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary antenna design disclose a technique for omnidirectional signal propagation for MIMO systems, bypassing the need for beamforming. The antenna design may involve positioning three antenna topologies along the surface and around the edges of a circuit board to maximize signal coverage. End fire antennas in a four-dipole Yagi-Uda configuration may be positioned around the edges of the circuit board, and either slotted waveguide or cross-slot broadside antennas may be positioned in the center of the circuit board. The antenna design may achieve a combined 3 dB scan angle of more than −145° to 145° in both planes with a very low correlation coefficient between ports. Whereas a phased array antenna typically provides a scan range of only −60° to 60°.

Figure 1:
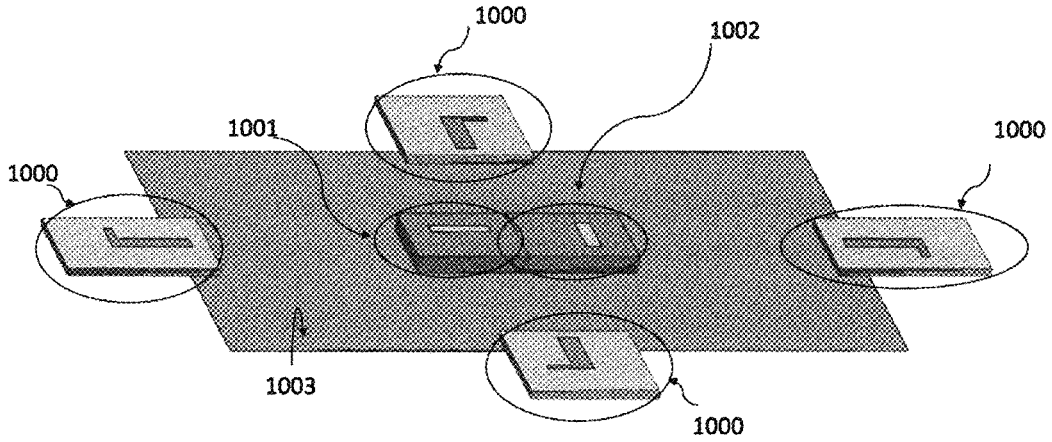
FIG. 1 is a perspective view of an exemplary six-port MIMO antenna system in accordance with one aspect of the present application.
Figure 4:
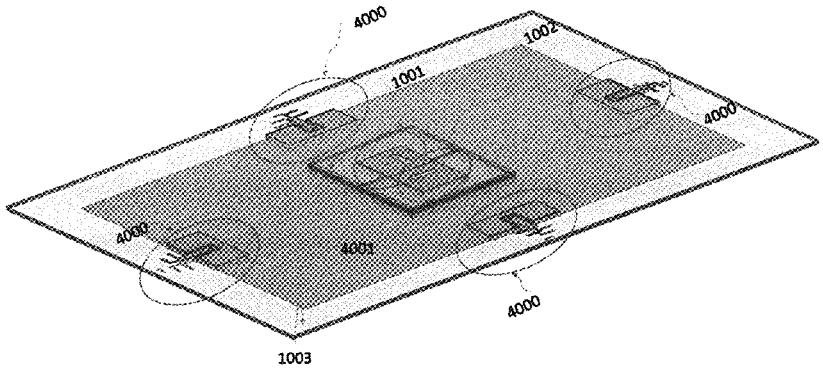
FIG. 4 is a perspective view of an exemplary six-port MIMO antenna system with two central slotted waveguide antennas and four peripheral four-dipole end fire antennas in accordance with one aspect of the present application.

Referring to FIGS. 1 and 4, a MIMO antenna device 1 (hereinafter device 1) may be seen. The device 1 may be formed on a dielectric substrate 1003. Many commercial antenna products use off-the-shelf FR4 dielectric material. F4 dielectric material may be formed of a glass-reinforced epoxy laminate material. However, F4 dielectric material may be inherently lossy at millimeter-wave frequencies. Thus, the device 1 may use a Liquid Crystal Polymer (LCP) circuit board (hereinafter LCP) for the dielectric substrate 1003. LCP may provide a low-loss dielectric material for millimeter-wave antenna design and is a cheaper alternative to expensive RT duroid. RT duroid is a high frequency circuit material filled Polytetrafluoroethylene (PTFE) composite laminate. While RT duroid materials may have features like low electrical loss and low moisture absorption, the material is expensive since it requires tightly controlled processing steps to achieve consistent yield.

The dielectric substrate 1003 may be formed of a plurality of layers of LCP 2005. Each layer of LCP 2005 may be connected with another layer of LCP 2005 with an adhesive layer 2004. In accordance with one embodiment, the adhesive layer 2004 may be adhesive layers of FL A3000 paste or similar materials.

The device 1 may have four end fire antennas 1000 in MIMO configuration attached around an edge of the dielectric substrate 1003. An individual end fire antenna 1000 may be attached to each side edge of the dielectric substrate 1003 and around a perimeter of the dielectric substrate 1003. In accordance with one embodiment, the end fire antennas 1000 may exhibit a wide −10 dB return loss band from 22.8 to 44 GHz to support three proposed bands for 5G communication. In accordance with one embodiment, the end fire antennas 1000 may be Yagi-Uda antenna elements.

The device 1 may support additional channels other than those of the four end fire antennas 1000. The device 1 may have two additional channels. The two additional channels may be supported in the broadside direction with a pair of slotted resonant waveguide antennas 1001 and 1002 attached on a top surface in a center area of the dielectric substrate 1003.

Figure 2:
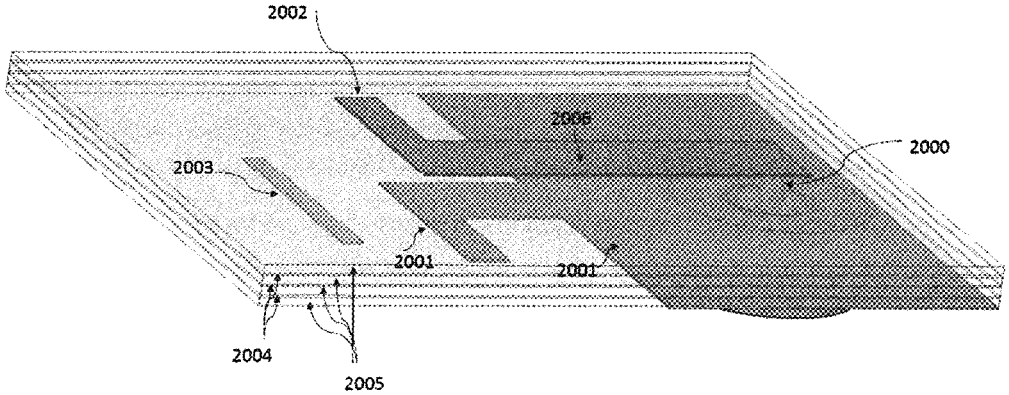
FIG. 2 is a perspective view of an of an exemplary single-dipole element in Yagi-Uda configuration used in the six-port MIMO antenna system in accordance with one aspect of the present application.
Figure 5:
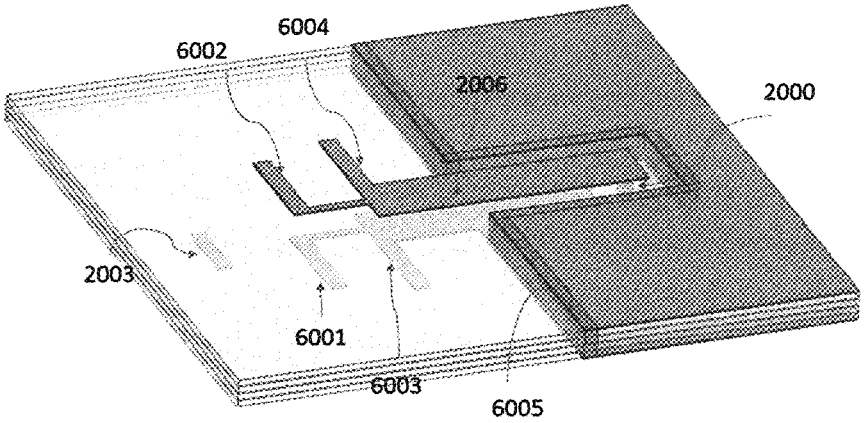
FIG. 5 is a perspective view of an exemplary two-dipoles element in Yagi-Uda configuration used in the six-port MIMO antenna system in accordance with one aspect of the present application.
Figure 6:
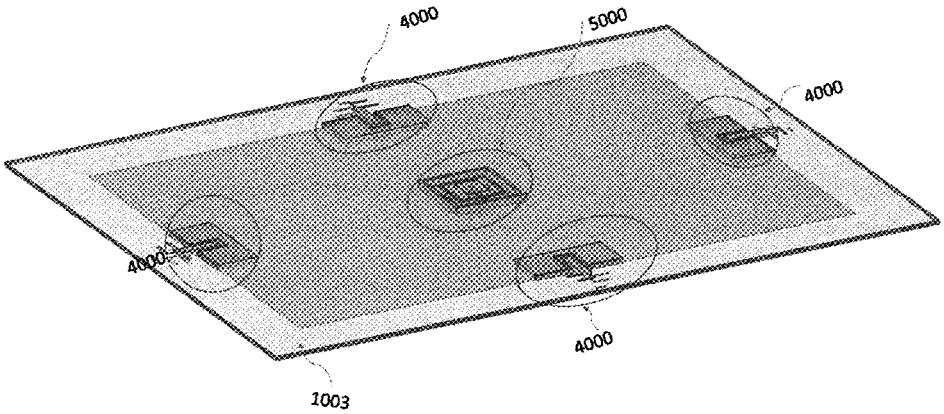
FIG. 6 is a perspective view of an exemplary MIMO antenna system with cross-slot patch antenna for broadside radiation in accordance with one aspect of the present application.

The four end fire antennas 1000 may be formed in a four-dipole configuration 4000 as shown in FIGS. 4 and 6. As may be seen in FIGS. 2 and 5, each of the end fire antennas 1000 forming the four-dipole configuration 4000 may consist of an upper dipole pair 2002 and a lower dipole pair 2001. The upper dipole pair may be formed of a set of parallel dipoles 6002/6004 while the lower dipole pair 2001 may be formed of a set of parallel dipoles and 6001/6003. The set of parallel dipoles 6002/6004 and 6001/6003 may each be of a different length to support separate $\lambda/2$ resonance modes. The configuration may be designed to facilitate triple band (i.e. wideband) MIMO operation. A wideband impedance match supporting three 5G frequency bands may be achieved with no change to the desired end fire radiation pattern as compared to a single-dipole resonator.

A dipole may have capacitive reactance for frequencies below the resonance frequency and inductive reactance for frequencies above the resonance frequency. The upper and lower dipole pairs 2002 and 2001 respectively may be sized so that the position of their resonance frequencies may result in cancelled reactance profiles, widening the impedance match to cover the mid-band region. Their separation may be optimized to minimize mutual coupling (nearly zero). A more closely positioned second dipole may overload the primary mode of the longer dipole and does not result in the same wideband impedance match.

A metallic wall 6005 may surround the back and sides of each of the antennas 1000 forming the four-dipole configuration 4000. The metallic wall 6005 may be used to suppresses surface wave propagation. The metallic wall 6005 around the backside of the antennas 1000 may decrease mutual coupling and cross-polarization radiation between the antennas 1000 and other antenna elements of the device 1. It may also reduce circuitry interference.

The metallic wall 6005 may have a height to width aspect ratio of 1:1 to simplify plating fabrication. A transmission line 2006 may connect the upper dipole pair 2006, dipole pair 6002/6004, to the coaxial probe 2000. The coaxial probe 2000 may reduce the influence of the transmission line 2006 on impedance matching and the radiation pattern of the device 1. The correlation between the coaxial probes 2000 is independent of element spacing provided the dielectric substrate 1003 is larger than the antennas 1000. In accordance with one embodiment, the transmission line 2006 may be a 50-ohm transmission line 2006.

The lower dipole pair 2001 may be connected to a finite ground plane 2007. The ground plane 2007 may have an opening hole 2008 for the feed probe 2000. A parasitic element 2003 may be mounted parallel to the drive elements of the lower and upper dipole pairs 2001 and 2002 respectively, with all the elements usually in a line perpendicular to the direction of radiation of the antenna. The effect of the parasitic element 2003 may have on the radiation pattern depends both on its separation from the next element, and on its length. In accordance with one embodiment, the parasitic element 2003 is a director radiator. The parasitic element 2003 may be formed on the same layer as the dipole pair 2001 and ground plane 2007. In accordance with one embodiment, the parasitic element 2003 may be separated by a quarter wavelength from the lower dipolar pair 2001.

Figure 3:
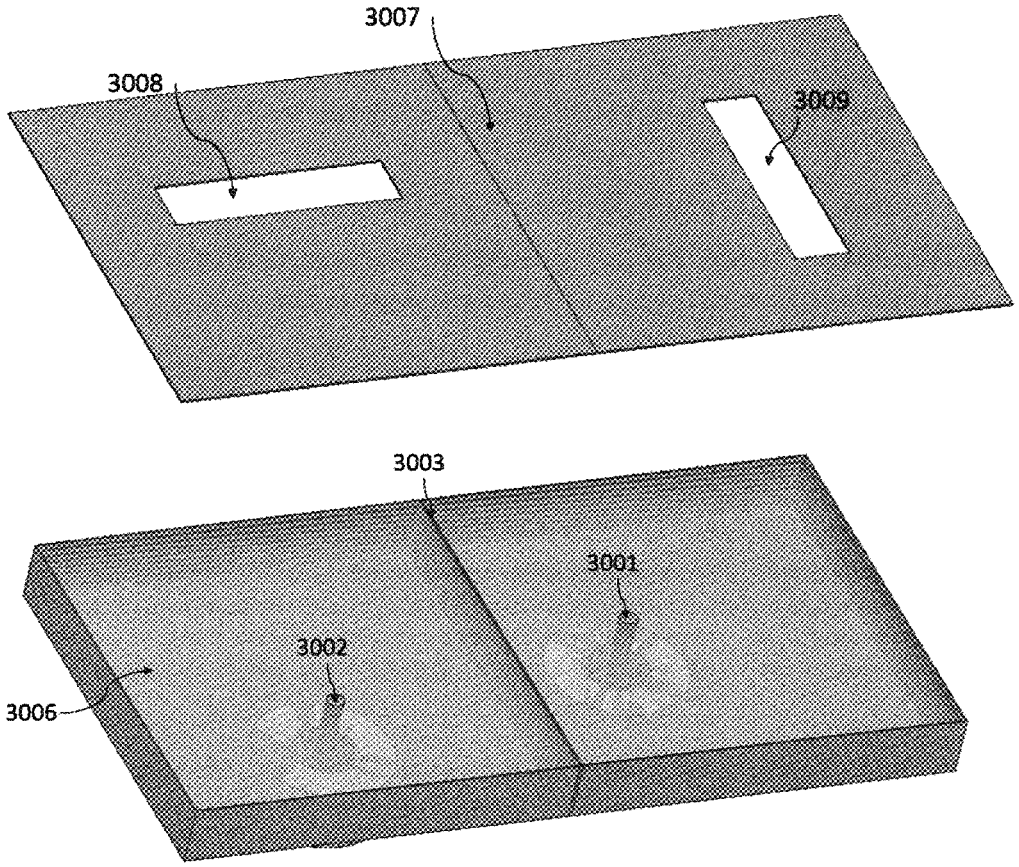
FIG. 3 is a perspective view of an exemplary slotted resonant waveguide (SRW) antenna element used in the six-port MIMO antenna system in accordance with one aspect of the present application.

Referring to FIG. 3, a plated trench 3003 may be formed in the dielectric substrate 1003. The trench 3003 may act like metallic walls and may form two square waveguides oriented in the broadside direction. Separate coaxial probes 3001 and 3002 may be formed on each side of the trench 3003 and may be used to feed two waveguide cavities. Two perpendicularly oriented rectangular slots 3008 and 3009 for orthogonal polarization may be etched into a top copper layer 3007.

In FIG. 4, the slotted antennas 1002 and 1003 may be surrounded by an additional metallic enclosure 4001. Without the enclosure 4001, the slotted antennas 1002 and 1003 may have issues with pattern flattening due to diffraction around board edges from surface waves and grazing waves. The metallic enclosure 4001 helps to orient the main lobe in the broadside direction, orthogonal to the end fire pattern produced around the peripheral. The frame size is optimized to stabilize the radiation patterns in both the E and H planes to changes in board size.

Figure 7:
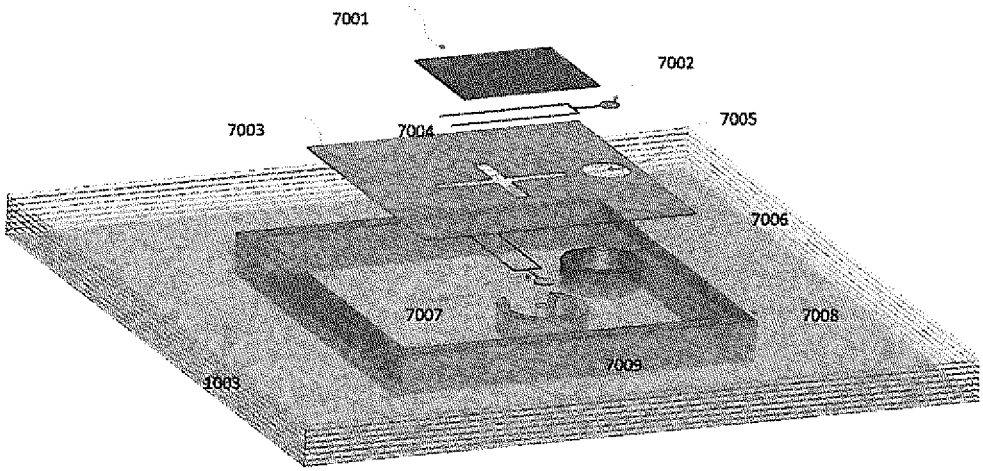
FIG. 7 is a perspective view of an exemplary cross-slot dual polarization antenna element with patch loading used in the six-port MIMO antenna system in accordance with one aspect of the present application.
Figure 8:
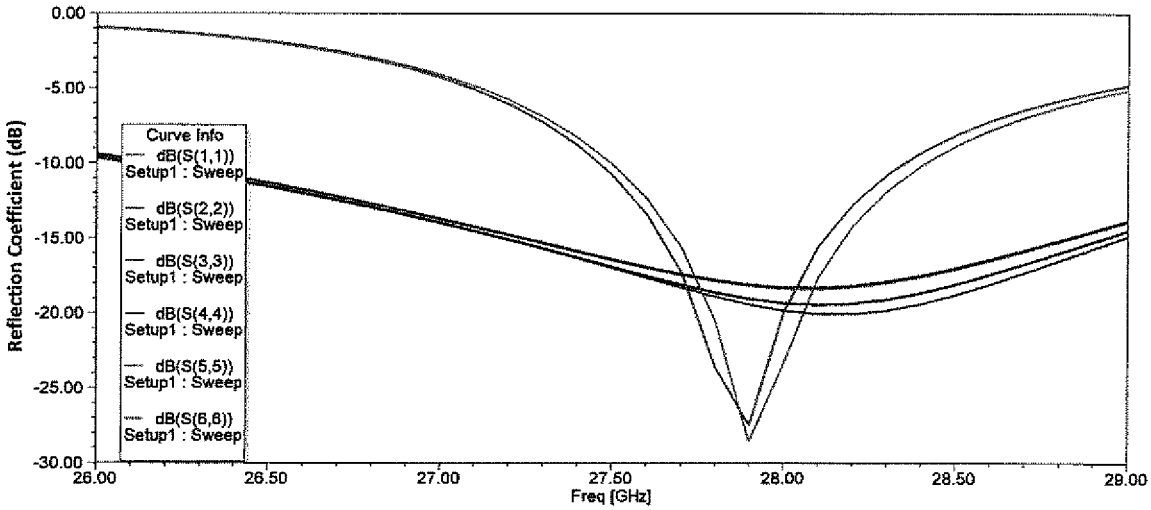
FIG. 8 is an exemplary plot showing reflection coefficient vs frequency for all six ports for the six port MIMO antenna system in accordance with one aspect of the present application.
Figure 9:
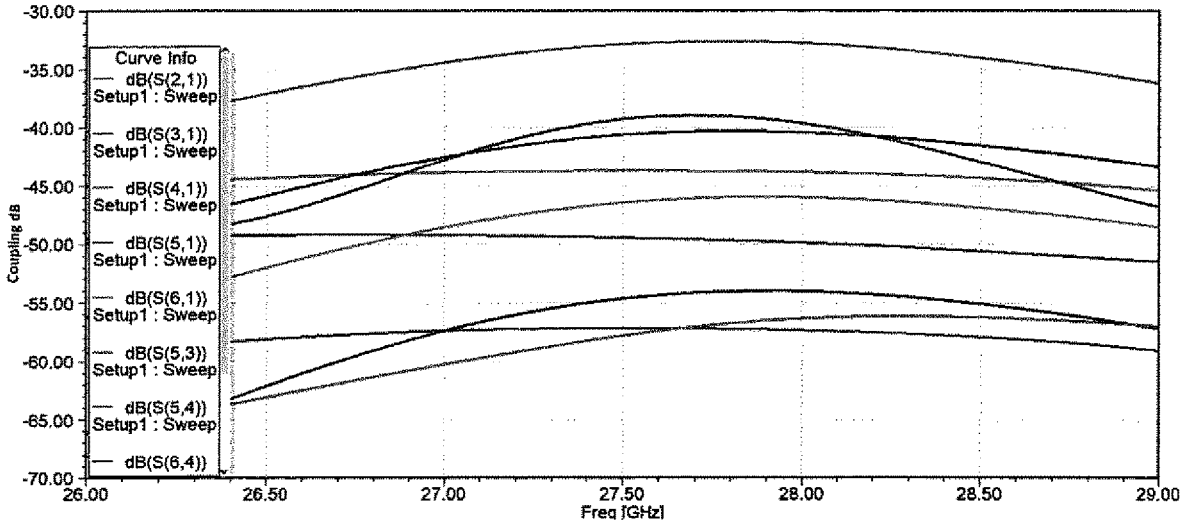
FIG. 9 is an exemplary plot showing mutual coupling between different antenna ports for the six port MIMO antenna system in accordance with one aspect of the present application.
Figure 10:
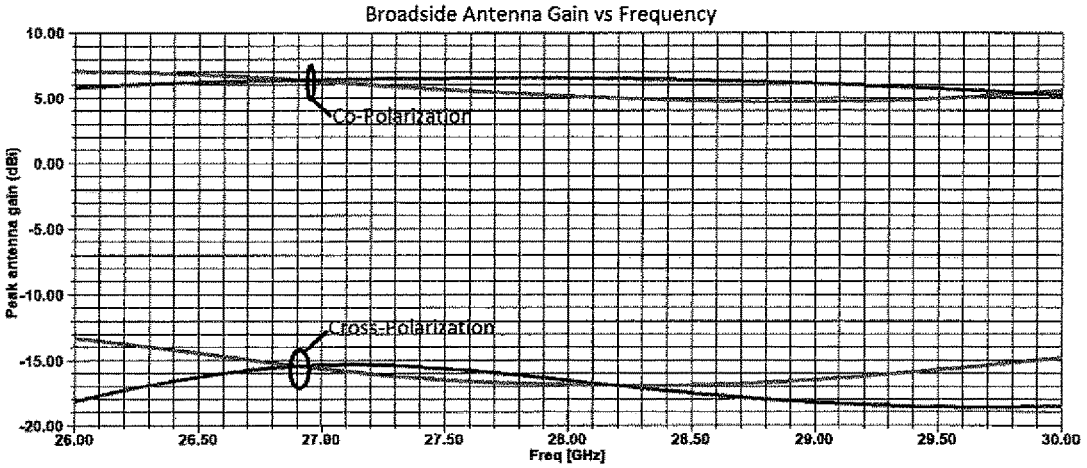
FIG. 10 is an exemplary plot showing broadside gain of SRW antenna elements for the six port MIMO antenna system in accordance with one aspect of the present application.
Figure 11:
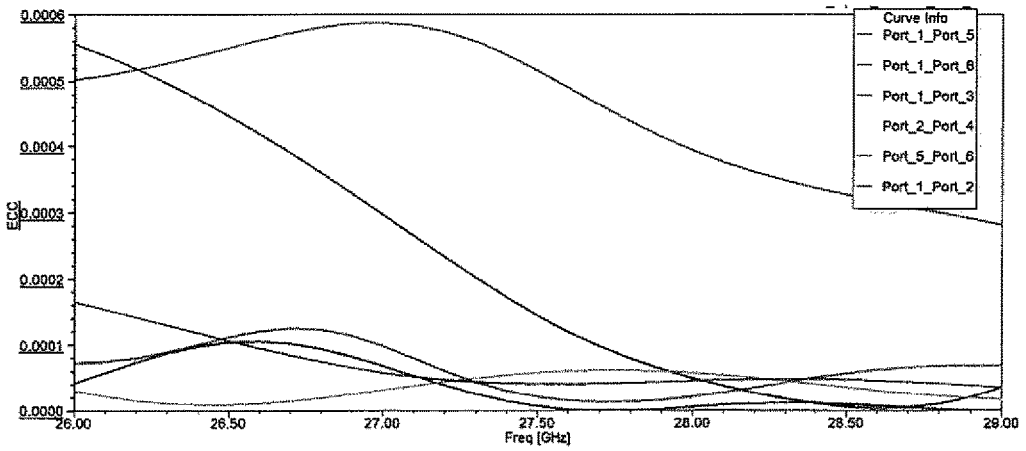
FIG. 11 is an exemplary plot showing envelope correlation coefficients between antenna ports for the six port MIMO antenna system in accordance with one aspect of the present application.
Figure 12:
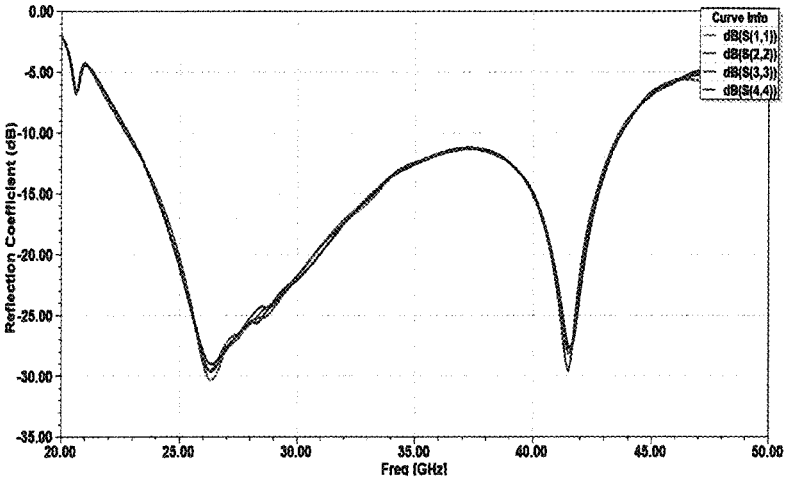
FIG. 12 is an exemplary plot showing reflection coefficient vs frequency plot for two-dipole end fire antenna for the six port MIMO antenna system in accordance with one aspect of the present application.

Referring to FIG. 6, an antenna 1' may be seen. In this embodiment, the antenna 1' uses the four-dipole configuration 4000 disclosed above. However, the antenna 1' may use a dual-port broadside antenna 5000. Details of the dual-port broadside antenna 5000 may be seen in FIG. 7. The orthogonally polarized radiation in the broadside direction supports two channels and may be emitted by cross-slot 7004 in copper plane 7003. Two orthogonal differential feed lines 7002 and 7007, one for each channel, may be positioned above and below the copper plane 7003 and parallel to the cross-slot opening. In accordance with one embodiment, the two orthogonal differential feed lines 7002 and 7007 may be 100-ohm differential feed lines. The higher impedance of the differential feed lines 7002 and 7007 over slots 7004 may help to match the higher impedance of the slot 7004. A 50-ohm probe may be used to connect the upper differential feedline 7002 to port 2 through an opening in the copper plane 7003. The lower differential feedline 7007 connects to port 1 with its own 50-ohm probe via. A parasitic patch radiator 7001 on the topmost layer may be used to further improve impedance matching and produces a broadside radiation pattern. A ring 7006 may be formed around the signal via at port 2 to reduce mutual coupling between ports and is a connection to ground for the cooper plane 7003. In accordance with one embodiment, the ring 7006 may be a copper plated ring. Similarly, ring 7009 may provide a ground shield for the signal via at port 1. In accordance with one embodiment, the ring 709 may be a copper plated ring. As with the slotted waveguide, the metallic wall 7008 surrounding the antennas and feed network may reduce the influence of ground plane size on the radiation pattern. It may also reduce mutual coupling between the central antenna unit and the peripheral end fire dipole antennas.

The device 1 and 1' are multiport antenna systems fabricated on LCP technology for applications in wireless communication systems. More specifically, the devices 1 and 1' may be used for 5G communications. The devices 1 and 1' may allow for signals on separate ports to be steered without analog or digital beamforming techniques.

As may be seen in FIGS. 9-12, the devices 1 and 1' may support end fire radiation around the edge of the dielectric substrate 1003 and two orthogonal polarization channels in the broadside direction. The cross-polarization for the broadside channels may be down by more than 20 dB. Mutual coupling between the end fire elements and central broadside antennas may be around −30 dB and −20 dB for the slotted waveguide and cross-slot configurations, respectively. The peak antenna gain in the broadside direction may be more than 5 dBi in the 5G band, while peak gain in the end fire directions may be more than 6 dBi. The 10 dB return loss bandwidth for the single-dipole end fire antennas may be more than 10%, the two-dipole configuration may be more than 60%, the slotted waveguide resonator antenna may be 4%, and the cross-slot loaded patch antenna may be around 6%. The end fire antennas 1000 may use a floating director radiator to enhance the gain and reduce the correlation coefficient between them. The gain in the broadside direction may be kept reasonably high by using protective metallic walls 6005 around the radiating elements. The circuit board electronics have minimal effects on antenna performance.

The foregoing description is illustrative of particular embodiments of the application, but is not meant to be a limitation upon the practice thereof. The following claims, including all equivalents thereof, are intended to define the scope of the application.

What is claimed is:

1. An antenna assembly comprising:

a dielectric substrate; and a plurality of end fire antennas in a Yagi-Uda configuration positioned at edges of the dielectric substrate, wherein each of the end fire antennas comprises:

an upper dipole pair;

a lower dipole pair; and a metallic wall formed around a back and side areas of the upper dipole pair and the lower dipole pair;

wherein the upper dipole pair is formed of a first set of parallel dipoles and the lower dipole pair is formed of a second set of parallel dipoles, the first set of parallel dipoles and the second set of parallel dipoles each being of a different length to support separate $\lambda/2$ resonance modes, wherein $\lambda$ is a wavelength of a 5G frequency band.

2. The antenna assembly of claim 1, wherein each of the end fire antennas comprises two dipoles connected in parallel as a respective radiating element.

3. The antenna assembly of claim 1, wherein the metallic wall has a height to width aspect ratio of 1:1.

4. The antenna assembly of claim 1, comprising:

a ground plane coupled to the lower dipole pair; and a transmission line coupled to the upper dipole pair.

5. The antenna assembly of claim 4, wherein the transmission line is a 50-ohm transmission line.

6. The antenna assembly of claim 1, comprising a parasitic element mounted parallel to the lower dipole pair and the upper dipole pair.

7. The antenna assembly of claim 1, wherein the dielectric substrate is a multi-layer Liquid Crystal Polymer (LCP) circuit board.

8. An antenna assembly comprising:

a dielectric substrate, wherein the dielectric substrate is a multi-layer Liquid Crystal Polymer (LCP) circuit board;

a plurality of end fire antennas in a Yagi-Uda configuration positioned at edges of the dielectric substrate, wherein each of the end fire antennas comprises:

an upper dipole pair;

a lower dipole pair, wherein the upper dipole pair is formed of a first set of parallel dipoles and the lower dipole pair is formed of a second set of parallel dipoles, the first set of parallel dipoles and the second set of parallel dipoles each being of a different length to support separate $\lambda/2$ resonance modes, wherein $\lambda$ is a wavelength of a 5G frequency band;

a metallic wall formed around a back and side areas of the upper dipole pair and the lower dipole pair;

a ground plane coupled to the lower dipole pair;

a transmission line coupled to the upper dipole pair; and a device for dual polarized broadside radiations formed on a top surface of a center area of the dielectric substrate.

9. The antenna assembly of claim 8, comprising a parasitic element mounted parallel to the lower dipole pair and the upper dipole pair.

10. The antenna assembly of claim 8, comprising a pair of slotted resonant waveguide antennas formed on a top surface of a center area of the dielectric substrate.

11. The antenna assembly of claim 8, comprising a cross-slot antenna formed on a top surface of a center area of the dielectric substrate.

* * * * *